US008608427B2

(12) United States Patent
Böck

(10) Patent No.: US 8,608,427 B2
(45) Date of Patent: Dec. 17, 2013

(54) ARRANGEMENT FOR OPTIMISING THE RUNNING CLEARANCE FOR TURBOMACHINES

(75) Inventor: Alexander Böck, Kottgeisering (DE)

(73) Assignee: MTU Aero Engines GmbH, Munich (DE)

( * ) Notice: Subject to any disclaimer, the term of this patent is extended or adjusted under 35 U.S.C. 154(b) by 887 days.

(21) Appl. No.: 12/376,398

(22) PCT Filed: Aug. 8, 2007

(86) PCT No.: PCT/DE2007/001416

§ 371 (c)(1),
(2), (4) Date: Apr. 30, 2010

(87) PCT Pub. No.: WO2008/019657

PCT Pub. Date: Feb. 21, 2008

(65) Prior Publication Data

US 2010/0232942 A1 Sep. 16, 2010

(30) Foreign Application Priority Data

Aug. 17, 2006 (DE) ..... 10 2006 038 753

(51) Int. Cl.
*F01D 11/12* (2006.01)

(52) U.S. Cl.
USPC ..... 415/14; 415/118; 415/128; 415/135; 415/138; 415/173.2

(58) Field of Classification Search
USPC ..... 415/14, 118, 126, 128, 134, 135, 138, 415/173.1, 173.2
See application file for complete search history.

(56) References Cited

U.S. PATENT DOCUMENTS

| | | | | |
|---|---|---|---|---|
| 3,227,418 | A * | 1/1966 | West | 415/127 |
| 4,334,822 | A | 6/1982 | Rossmann | |
| 4,875,828 | A * | 10/1989 | Willkop et al. | 415/173.4 |
| 5,871,333 | A * | 2/1999 | Halsey | 415/173.1 |
| 6,454,529 | B1 | 9/2002 | Zearbaugh et al. | |
| 7,686,569 | B2 * | 3/2010 | Paprotna et al. | 415/1 |

FOREIGN PATENT DOCUMENTS

| | | |
|---|---|---|
| DE | 102 33 881 A1 | 2/2004 |
| GB | 2 108 591 A | 5/1983 |

* cited by examiner

*Primary Examiner* — Igor Kershteyn
(74) *Attorney, Agent, or Firm* — Greer, Burns & Crain, Ltd.

(57) ABSTRACT

An arrangement for optimizing the running clearance for turbomachines of the axial type, such as turbocompressors, gas turbines, and steam turbines, in particular for compressors of stationary gas turbines, by controlling the inner diameter, which is relevant to the running clearance, of at least one stator structure that surrounds a rotor blade ring, including: the stator structure has a closed, circular inner ring, a circular outer ring that is situated concentric to the inner ring at a radial distance therefrom, and a plurality of links that integrally connect the inner ring to the outer ring, the links being circumferentially inclined at a defined angle (α) to the radial direction and distributed around the circumference of the stator structure, and the arrangement includes an adjustment device for rotating the inner ring relative to the outer ring with elastic modification of the running clearance-relevant inner diameter (D) of the inner ring.

13 Claims, 3 Drawing Sheets

ARRANGEMENT FOR OPTIMISING THE RUNNING CLEARANCE FOR TURBOMACHINES

BACKGROUND

The present invention relates to an arrangement for optimizing the running clearance for turbomachines that are at least partially of the axial type, by controlling or regulating the inner diameter, which is relevant to the running clearance, of at least one stator structure that surrounds a rotor blade ring.

Persons skilled in the art usually refer to this technology as Active Clearance Control, or ACC. As a rule, the known designs using this construction are based on the principle of supplying areas of the housing or stator elements with a flow of low-temperature air, i.e. cooling air, in a defined fashion in order to influence the running clearance via thermal contraction of these components. A reduction or interruption in the flow of cooling air causes the components to expand again. This procedure is more effective the greater the temperature difference between the component and the cooling air. Preferably, a hot turbine stator is supplied with relatively cool air from a compressor. Such an arrangement is disclosed for example in U.S. Pat. No. 6,454,529 B1. In compressors, the development also includes active monitoring of the maintaining of the clearance. Thermal influencing of the housing or stator reaches its limit in particular in compressors, due to small temperature differences. Thus, there is a demand for systems that perform better and that react faster.

SUMMARY

Against the background of the known solutions, the object of the present invention is to propose an arrangement for optimizing the running clearance in turbomachines that are at least partly of the axial type, said arrangement having particularly fast reaction time and high power, and thus being suitable for use in compressors.

This object is achieved by the arrangement having a new type of stator structure having an inner ring, an outer ring concentric thereto at a radial distance therefrom, and a plurality of links that integrally connect the rings. All of the links are inclined in the circumferential direction by the same angle, relative to the radial direction. In addition, the arrangement comprises an adjustment device for rotating the inner ring relative to the outer ring, with elastic modification of the running clearance-relevant inner diameter. Thus, the present invention relates to a mechanical arrangement that, starting from a "center position" free of adjustment forces, enables both a compression and an expansion of the inner ring, depending on the direction of rotation, with elastic, reversible deformation. The reaction speed of the arrangement is a function predominantly of the speed of the selected adjustment device. Because the present invention does not rely on thermally induced deformations, significant improvement can be achieved with respect to speed, e.g. using hydraulic, pneumatic, or piezoelectric force-producing devices. This also has the advantage that for the adjustment it is not necessary to take any process gas stream from the engine, or at least not to any significant extent.

In the following, the present invention is explained in more detail on the basis of the drawings, which are simplified and not to scale.

DETAILED DESCRIPTION

Figure 1:
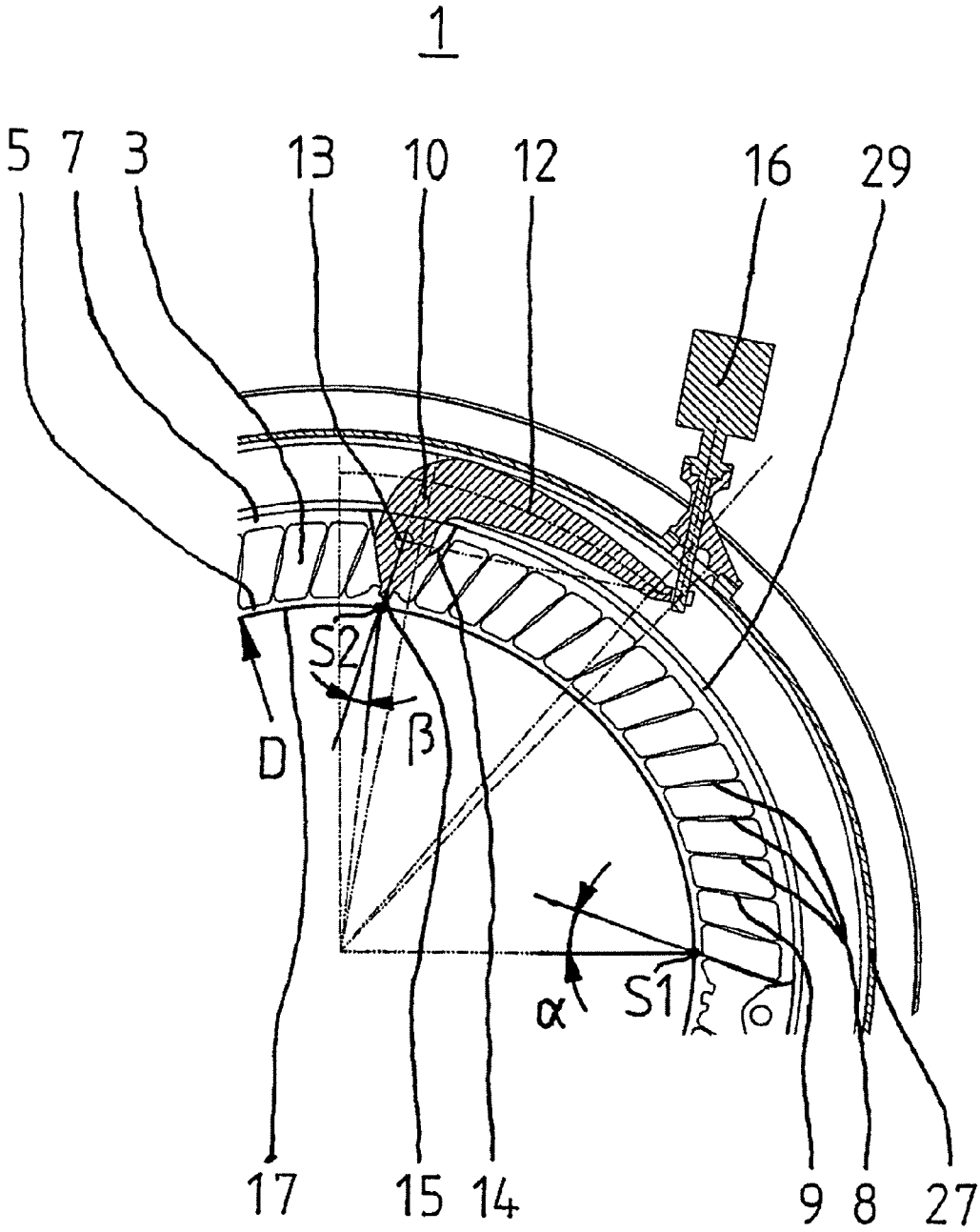
FIG. 1 shows a partial cross-section through an arrangement for optimizing the running clearance.

Arrangement 1 for optimizing the running clearance comprises two essential functional units, the first of which is an integral, elastically deformable stator structure 3, and the second of which is an adjustment device having at least one lever 10, at least one actuator 16, and at least one sensor 18 for acquiring the running clearance. Stator structure 3 is essentially made up of a circular, closed inner ring 5, a circular outer ring 7 situated concentrically to the inner ring at a radial distance therefrom, and a plurality of links 8, distributed around the circumference of stator structure 3, that connect inner ring 5 to outer ring 7 integrally and so as to be elastically rotatable relative to each other. Links 8 are inclined in the circumferential direction by a defined angle $\alpha$ relative to the radial direction, so that a relative rotation of inner ring 5 and outer ring 7 causes a reversible compression or expansion of inner ring 5 and thus a change in the running clearance-relevant inner diameter D. The cross-section of inner ring 5 is thinner than that of outer ring 7, so that inner ring 5 is significantly more flexible. This has the result that the desired change in diameter results essentially from the deformation of inner ring 5. The radially inner and radially outer ends of links 8 are connected integrally to inner ring 5 and to outer ring 7, and are realized as elastic solid-body joints. It can be seen that links 8 are contoured over their radial length, such that the radially center area 9 is thicker than the ends, and is thus more rigid. Thus, over most of their radial length links 8 behave in the manner of rigid bodies, which amplifies the change in diameter of inner ring 5 for a given relative rotation. Links 8 may also be contoured along their axial extension. Their axial depth may be larger at outer ring 7 than at inner ring 5, having a conical taper between them. In this way, the adjustment forces can be reduced with high axial rigidity. This contouring is not shown in the Figures. Outer ring 7 is mounted in a housing-type bearer 29 so as to resist rotation, so that it forms the truly static element of stator structure 3. Inner ring 5, which may come into contact with rotor blade tips (not shown in FIG. 1), is provided on its radially inner side with a friction-tolerant rub coating 17 whose inner side determines the running clearance-relevant inner diameter D. Rub coating 17 follows the elastic deformation (compression, expansion) of inner ring 5.

In addition to stator structure 3, FIG. 1 also shows essential elements of the adjustment device. The transmission of force between inner ring 5 and outer ring 7 that brings about the relative rotation takes place mechanically. For this purpose, a bearing 13 for a lever 10 is situated at least one location on the circumference of outer ring 7, said bearing permitting pivot movements about an axis that runs parallel to the axis of rotation of the turbomachine. On inner ring 5 there is a corresponding recess that, together with a nose-type end of lever 10, forms a positively fitting, low-friction joint 15 that is maximally free of play. The connecting line from joint 15 to bearing 13 (center to center) runs at an angle $\beta$ to the radial direction. Because no supporting link 8 is present at this location, the kinematic behavior of the adjustment, including angle $\beta$, is designed in such a way that the local clearance-relevant deformation of inner ring 5 corresponds as well as possible to the deformation in the area of a link 8. Here, angle β is as a rule different from angle α. Here angles α and β are (arbitrarily) defined in that the longitudinal midline of a link 8 and the connecting line from bearing 13 to joint 15 (center to center) are each advanced with the clearance-relevant inner diameter D, a connecting line is drawn from the axis of rotation of the turbomachine to each of the points of intersection S1, S2, and the acute angles are then determined between the respective connecting line "axis of rotation-point of intersection" and the longitudinal midline "link," as well as the connecting line "bearing-joint." The angles are comparable only if the decisive points of intersection S1, S2 are situated on the same diameter, which however does not necessarily have to be inner diameter D. Lever 10 is angled so as to save space, its longer lever arm 12 being adapted to the cylindrical outer contour of outer ring 7, or of its bearer 29, while still running inside housing 27 of the turbomachine. The feedthrough of lever 10 through outer ring 7 in the area of bearing 13 is provided with a lip-type or sleeve-type seal 14 that separates the interior of stator structure 3 from the radially external surroundings, unless there is a connection via at least one end surface of stator structure 3. At the end of long lever arm 12 an actuator 16 engages that is mainly situated on the outside of housing 27 of the turbomachine. Actuator 16 is preferably constructed as a double-action (i.e., producing pressure and tensile forces) force cylinder that can be supplied with energy pneumatically, hydraulically, or electrically/electronically. Its situation on long lever arm 12 reduces the actuator forces and thus also its weight, etc. This increases only the required actuator stroke. In FIG. 1, at the lower right another gap is visible without a link 8, having a bearing and a joint fork for another lever 10 (not shown). Thus, given uniform distribution around the circumference, here four actuator/lever kinematic arrangements would be present. Theoretically, one kinematic system would suffice for the stator structure. It will probably be desirable to install two or more kinematic systems in order to achieve as uniform as possible a deformation of inner ring 5, and in order to provide redundancy.

Figure 2:
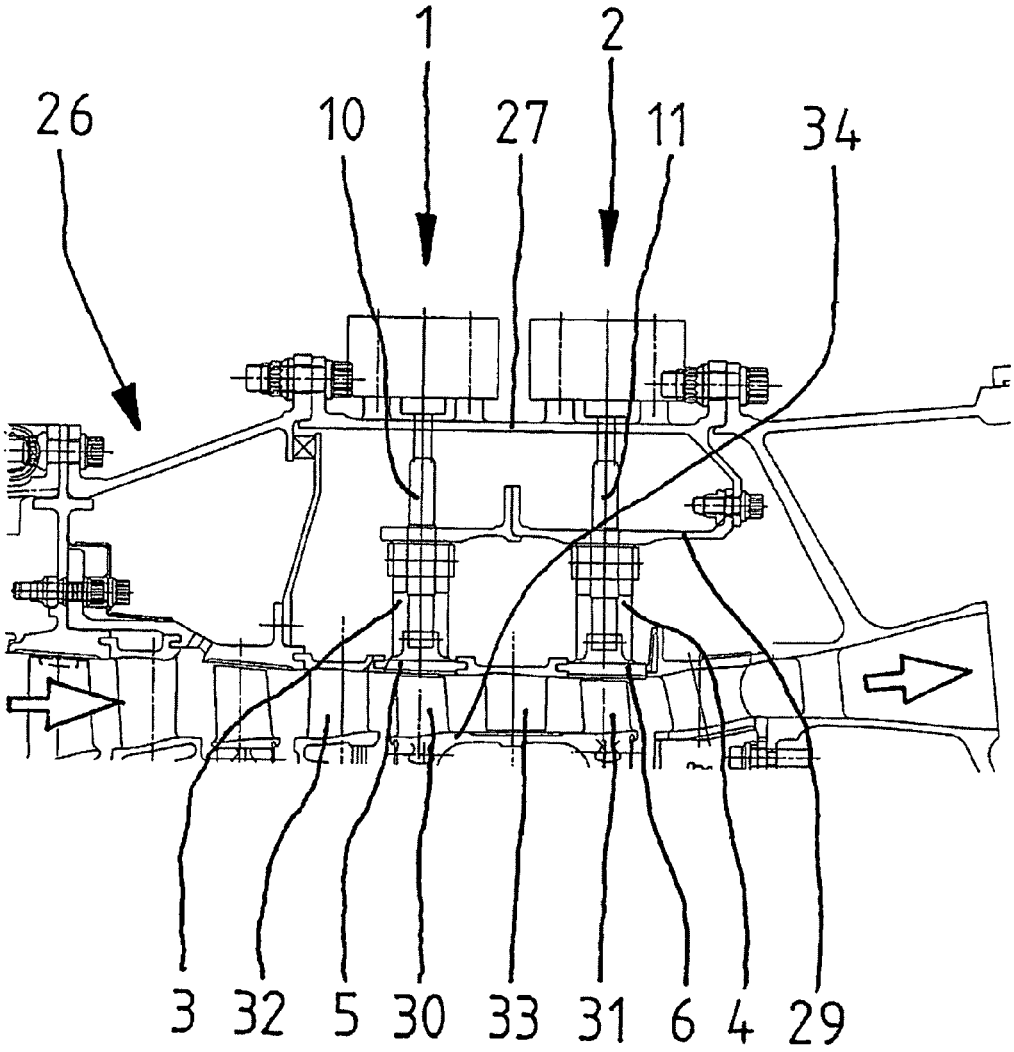
FIG. 2 shows a partial longitudinal section through a compressor having two arrangements for optimizing the running clearance.

FIG. 2 shows, as a concrete example, a multistage compressor 26 of the axial type, having two arrangements 1, 2 according to the present invention for optimizing the running clearance, in partial longitudinal section. At the top of the figure, multi-part housing 27 of compressor 26, having flange connectors, can be seen. At the bottom of FIG. 2, the flow duct of the compressor can be seen, having a plurality of rotor blade and guide blade rings; part of rotor 34 is also visible. The axis of rotation (not shown) would run horizontally below the drawing. The flow through compressor 26 runs from left to right; see the white arrows. Arrangements 1, 2 are situated in the radial planes of rotor blade rings 30, 31, the axial distance being such that there is space between arrangements 1, 2 for another guide blade ring having guide blade ring segments 33. Inside housing 27 there is a common hearer 29 for the two stator structures 3, 4, said bearer being situated concentrically with a radial distance and being fastened to housing 27 via a flange connection. Levers 10, 11, which run through bearer 29, are visible, as are the two bases for the actuators (not shown), here seen at top on housing 27. Inner ring 5 of the left, upstream stator structure 3 is kinematically coupled at both sides to guide blade ring segments 32, 33. Inner ring 6 of right stator structure 4 is kinematically coupled at one side to guide blade ring segments 33. In this way, arrangements 1, 2 influence not only the running clearances of rotor blade rings 30, 31, i.e. the outer air seal, but also influence the clearances between rotor 34 and guide blade ring segments 32, 33, i.e. the inner air seal. Due to the coupling at both sides to inner rings 5 and 6, guide blade ring segments 33 are optimally entrained and execute the same movement as the rings. Guide blade ring segments 32, coupled to inner ring 5 at only one side, are not entrained to the same degree, but are still advantageously entrained.

Figure 3:
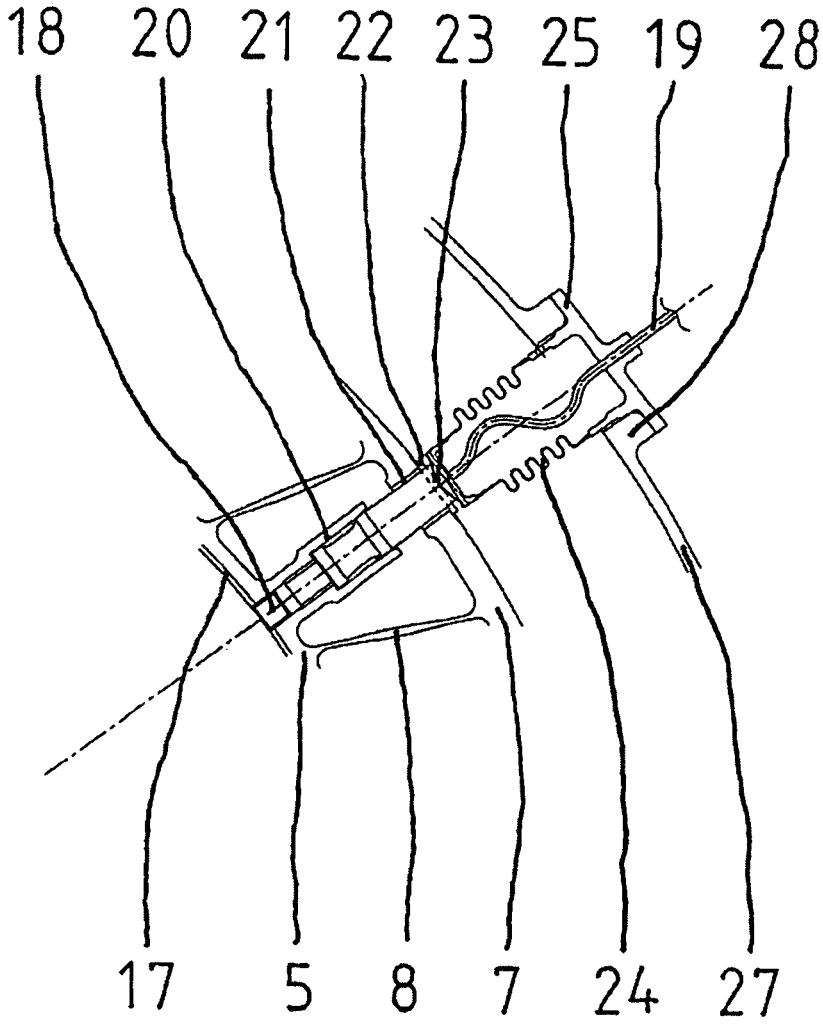
FIG. 3 shows a partial cross-section through an arrangement for optimizing the running clearance in the area of a sensor for acquiring the running clearance.

Controlling or regulation in the sense of an optimization requires that the actual, momentary running clearance be acquired at suitable time intervals and processed by control or regulating technology. In more stationary operating states, the time intervals between the measurements may be larger, while during highly non-stationary operating states measurements will be taken at shorter time intervals, up to continuous acquisition of measurement values. For reasons of redundancy alone, at least two sensors should be provided for the acquisition of the running clearance. Given a plurality of stages, the redundancy has an effect beyond the stages. A plurality of sensors on the circumference also makes it possible to acquire quasi-static eccentricities of the rotor relative to the stator. FIG. 3 shows, in partial cross-section, the area of such a sensor 18 within an arrangement for running clearance optimization. Sensor 18 is fixedly situated relative to inner ring 5, which immediately encloses a rotor blade ring. For this purpose, a sleeve-type mount 20 is integrated in inner ring 5, into which sensor 18 can be introduced radially from the outside against a stop, and can be removed. The active, radially inner sensor end is approximately flush with the inner surface of rub coating 17. A slight radially outward setback ensures that sensor 18 is not damaged by the rubbing of the rotor blade tips. In any case, the rub coating must have a "window," i.e. an opening, in the area of sensor 18. Depending on the spacing of links 8 around the circumference, if necessary at least one link 8 must be omitted in order to provide space for sensor 18 together with its mount 20. Because inner ring 5 is rotated together with sensor 18 relative to outer ring 7 in order to optimize the clearance, a feedthrough 21 toward the sensor shaft is provided in outer ring 7, having sufficient play in the circumferential direction. In order to seal opening 21, a sealing ring 22 capable of sliding is situated so as to lie on the outer diameter of outer ring 7; said sealing ring is radially loaded from the outside by a spring disk 23. Between housing 27 of compressor 26 and outer ring 7 a folding bellows 24 extends radially, forming an elastic, open duct for a flexible connecting line 19 of sensor 18. Bellows 24 is also used to hold sensor 18 in its operating position by exerting a defined radial force. Bellows 24 is connected to a cover 25 that is fastened in detachable, sealing fashion, preferably by a screw connection, to a flange 28 of housing 27. Connecting line 19 leads to electrical or electronic components that are part of the control/regulation system of the at least one actuator 16 that ultimately carries out the clearance optimization.

The invention claimed is:

1. An arrangement for optimizing the running clearance for turbomachines, comprising:

at least one stator structure having a closed, circular inner ring, a circular outer ring situated concentric to the inner ring at a radial distance therefrom, and a plurality of links that integrally connect the inner ring to the outer ring, said links being inclined in the circumferential direction at a defined angle to the radial direction and distributed around the circumference of the stator structure, and an adjustment device for rotating the inner ring relative to the outer ring with elastic modification of the running clearance-relevant inner diameter of the inner ring.

2. The arrangement as recited in claim 1, wherein the adjustment device comprises at least one lever that is pivotably held on the outer ring and is positively connected in jointed fashion to the inner ring, and at least one actuator that moves the lever.

3. The arrangement as recited in claim 2, wherein the at least one lever is angled, being adapted over the larger part of its length to the outer diameter of the outer ring, and being sealed in the area of its mount on the outer ring.

4. The arrangement as recited in claim 2, wherein the at least one actuator is realized as a force cylinder and engages at the end of the long lever arm of the lever, outside the outer ring.

5. The arrangement as recited in claim 1, wherein at least one sensor configured to acquire the running clearance is fastened to the inner ring.

6. The arrangement as recited in claim 5, wherein the outer ring has at least one sealed feedthrough for the connecting line of the at least one sensor, as well as for the installation and removal of the at least one sensor through the outer ring.

7. The arrangement as recited in claim 5, wherein the at least one sensor is integrated into a control circuit for operating the at least one actuator.

8. The arrangement as recited in claim 1, wherein the inner ring is constructed with a thinner cross-section, and is thus more easily deformable, than the outer ring.

9. The arrangement as recited in one claim 1, wherein the links are constructed so as to be contoured, and are thus thicker in the radially central area between the inner ring and the outer ring.

10. The arrangement as recited in claim 2, wherein the inclination of the at least one lever between its bearing on the outer ring and its connection to the inner ring, at a defined angle to the radial direction, is selected with regard to the optimal roundness of the inner ring via the adjustment movement, and is different from the inclination of the links relative to the radial direction.

11. The arrangement as recited in claim 1, wherein the inner ring of the at least one stator structure is kinematically coupled on at least one side to guide blade ring segments, thus also influencing the running clearance of said segments to the rotor.

12. The arrangement as recited in one claim 1, wherein the at least one stator structure is designed to make the running clearance-relevant inner diameter smaller by approximately −0.2% by compressing the inner ring, and to enlarge the running clearance-relevant inner diameter by approximately +0.2% by expanding the inner ring.

13. The arrangement as recited in claim 1, wherein the links on the outer ring have a greater depth in the axial direction than on the inner ring, and taper conically from the outer ring toward the inner ring.

* * * * *